US010930465B2

(12) United States Patent
Sommer et al.

(10) Patent No.: US 10,930,465 B2
(45) Date of Patent: Feb. 23, 2021

(54) BORON X-RAY WINDOW

(71) Applicant: Moxtek, Inc., Orem, UT (US)

(72) Inventors: Jared Sommer, Bountiful, UT (US); Jonathan Abbott, Saratoga Springs, UT (US)

(73) Assignee: Moxtek, Inc., Orem, UT (US)

( * ) Notice: Subject to any disclaimer, the term of this patent is extended or adjusted under 35 U.S.C. 154(b) by 0 days.

(21) Appl. No.: 16/826,581

(22) Filed: Mar. 23, 2020

(65) Prior Publication Data

US 2020/0234909 A1 Jul. 23, 2020

Related U.S. Application Data

(63) Continuation of application No. 16/208,823, filed on Dec. 4, 2018, now Pat. No. 10,636,614.

(60) Provisional application No. 62/614,606, filed on Jan. 8, 2018, provisional application No. 62/642,122, filed on Mar. 13, 2018.

(51) Int. Cl.
*H01J 35/18* (2006.01)

(52) U.S. Cl.
CPC ..... *H01J 35/18* (2013.01); *H01J 2235/183* (2013.01)

(58) Field of Classification Search
None
See application file for complete search history.

(56) References Cited

U.S. PATENT DOCUMENTS

| | | | | |
|---|---|---|---|---|
| 4,862,490 | A * | 8/1989 | Karnezos | H01J 5/18 378/161 |
| 5,226,067 | A | 7/1993 | Allred et al. | |
| 5,519,752 | A | 5/1996 | Spielman | |
| 9,502,206 | B2 | 11/2016 | Harker et al. | |
| 2008/0296479 | A1* | 12/2008 | Anderson | H01J 5/18 250/226 |
| 2008/0296518 | A1 | 12/2008 | Xu et al. | |
| 2012/0087476 | A1 | 4/2012 | Liddiard et al. | |
| 2013/0051535 | A1 | 2/2013 | Davis et al. | |
| 2017/0040138 | A1 | 2/2017 | Kumar et al. | |
| 2018/0323033 | A1 | 11/2018 | Black | |
| 2019/0002298 | A1 | 1/2019 | Hersam | |
| 2019/0056654 | A1 | 2/2019 | Peter | |

* cited by examiner

*Primary Examiner* — Hoon K Song
(74) *Attorney, Agent, or Firm* — Thorpe, North & Western, LLP

(57) ABSTRACT

An x-ray window can include a thin film that comprises boron. The thin film can be relatively thin, such as for example ≤200 nm. This x-ray window can be strong; can have high x-ray transmissivity; can be impervious to gas, visible light, and infrared light; can be easy of manufacture; can be made of materials with low atomic numbers, or combinations thereof. The thin film can include an aluminum layer. A support structure can provide additional support to the thin film. The support structure can include a support frame encircling an aperture and support ribs extending across the aperture with gaps between the support ribs. The support structure can also include boron ribs aligned with the support ribs.

20 Claims, 6 Drawing Sheets

BORON X-RAY WINDOW

CLAIM OF PRIORITY

This is a continuation of U.S. patent application Ser. No. 16/208,823, filed on Dec. 4, 2018, which claims priority to U.S. Provisional Patent Application Nos. 62/614,606, filed on Jan. 8, 2018, and 62/642,122, filed on Mar. 13, 2018, which are incorporated herein by reference.

FIELD OF THE INVENTION

The present application is related generally to x-ray windows.

BACKGROUND

Important characteristics of x-ray windows include strength; high x-ray transmissivity, particularly of low-energy x-rays; impervious to gas, visible light, and infrared light; and ease of manufacture. Another important characteristic of x-ray windows is use of materials with low atomic number in order to avoid contaminating the x-ray signal.

SUMMARY

It has been recognized that it would be advantageous to provide x-ray windows which are strong; have high x-ray transmissivity; are impervious to gas, visible light, and infrared light; are easy of manufacture; and are made of materials with low atomic numbers. The present invention is directed to methods of making x-ray windows that satisfy these needs. Each embodiment may satisfy one, some, or all of these needs.

The method can comprise placing a wafer in an oven; introducing a gas into the oven, the gas including boron, and forming a boron layer on a top face of the wafer; and etching the wafer to form support ribs extending from a bottom face of the wafer towards the boron layer.

In one embodiment, the boron layer can be a first boron layer, and the method can further comprise forming a second boron layer on a bottom face of the wafer. The method can further comprise etching the second boron layer to form boron ribs.

In another embodiment, the gas can include diborane. The single boron layer, the first boron layer, the second boron layer, or combinations thereof can comprise ≥96 weight percent boron and ≥0.1 weight percent hydrogen. The single boron layer, the first boron layer, the second boron layer, or combinations thereof can have density of ≥1.8 g/cm$^3$ ands ≤2.2 g/cm$^3$.

BRIEF DESCRIPTION OF THE DRAWINGS (DRAWINGS MIGHT NOT BE DRAWN TO SCALE)

Figure 1:
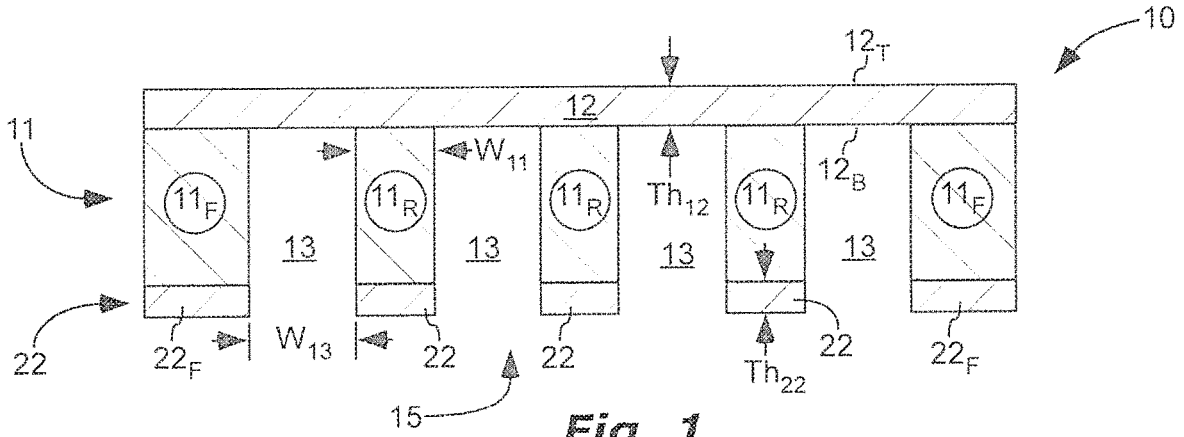

FIG. 1 is a schematic, cross-sectional side-view of an x-ray window 10 comprising a support structure 11 including a support frame $\mathbf{11}_F$ encircling an aperture 15 and support ribs $\mathbf{11}_R$ extending across the aperture 15; a boron layer 12 spanning the aperture 15; and boron ribs 22 aligned with the support ribs $\mathbf{11}_R$, the support ribs $\mathbf{11}_R$ sandwiched between the boron layer 12 and the boron ribs 22, in accordance with an embodiment of the present invention.

Figure 2:
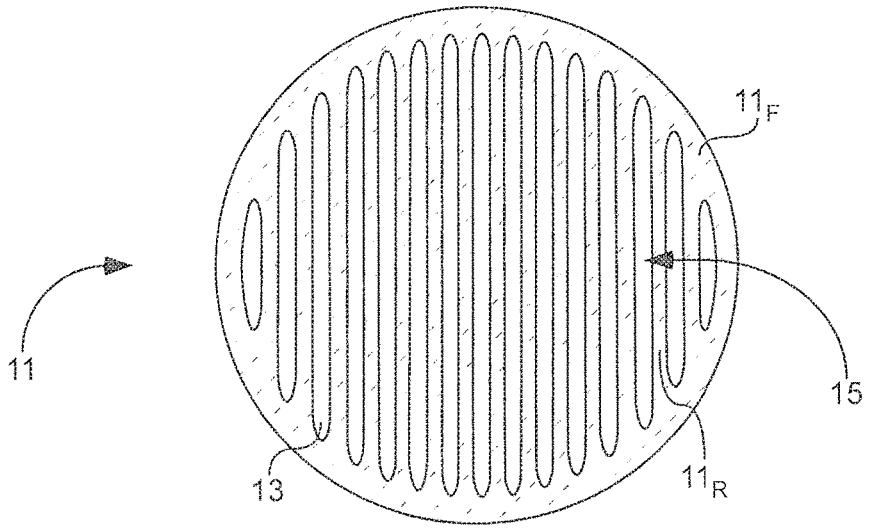

FIG. 2 is a schematic top-view of a support structure 11 for some of the x-ray window embodiments described herein, including a support frame $\mathbf{11}_F$ encircling an aperture 15 and support ribs $\mathbf{11}_R$ extending across the aperture 15, in accordance with an embodiment of the present invention.

Figure 3:
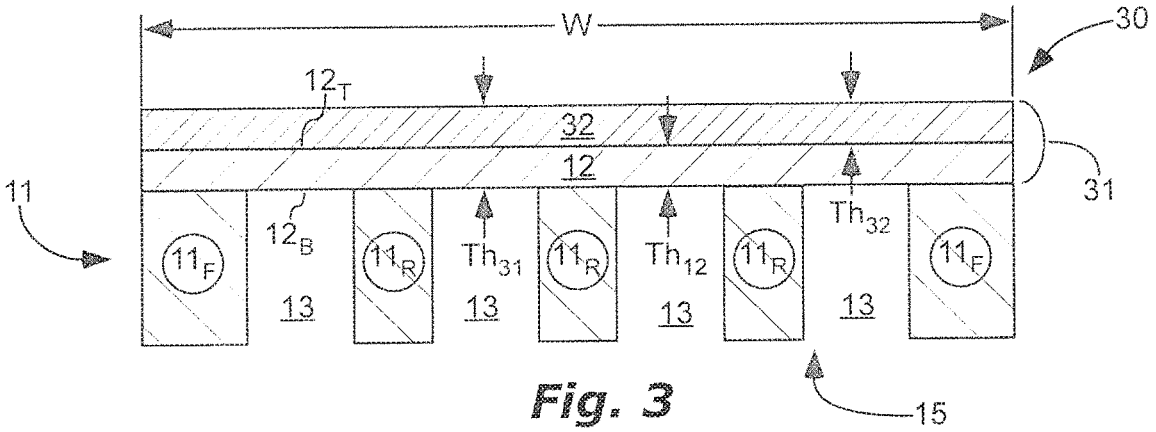
Figure 4A:
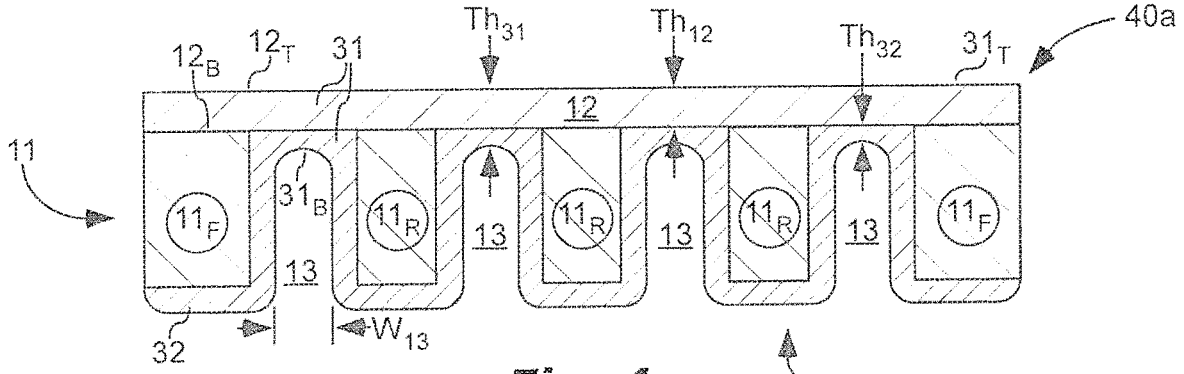
Figure 4B:
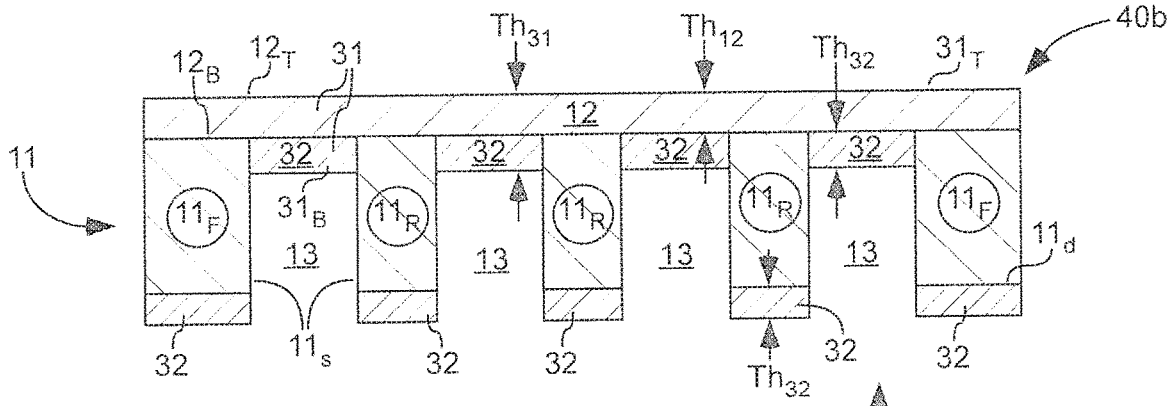
Figure 4C:
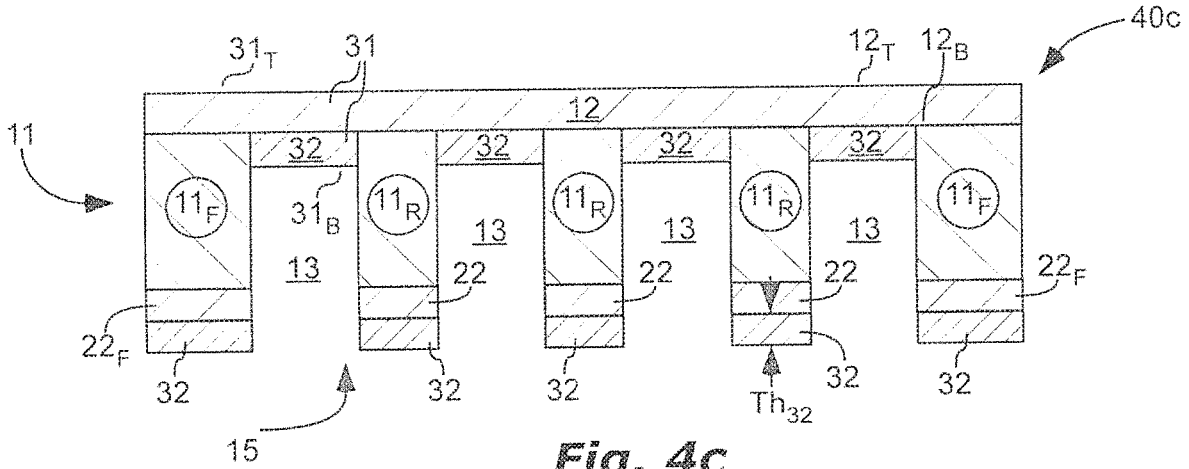

FIGS. 3-4*c* are schematic, cross-sectional side-views of x-ray windows 30, 40*a*, 40*b*, and 40*c*, similar to x-ray window 10, but further comprising an aluminum layer 32, the boron layer 12 and the aluminum layer 32 defining a thin film 31, in accordance with an embodiment of the present invention.

Figure 5:
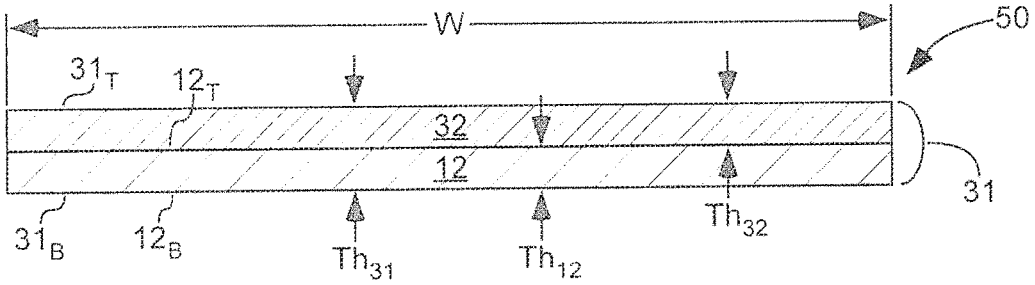

FIG. 5 is a schematic end-view of an x-ray window 50 comprising a thin film 31 (extending into the figure), the thin film 31 including boron, in accordance with an embodiment of the present invention.

Figure 6:
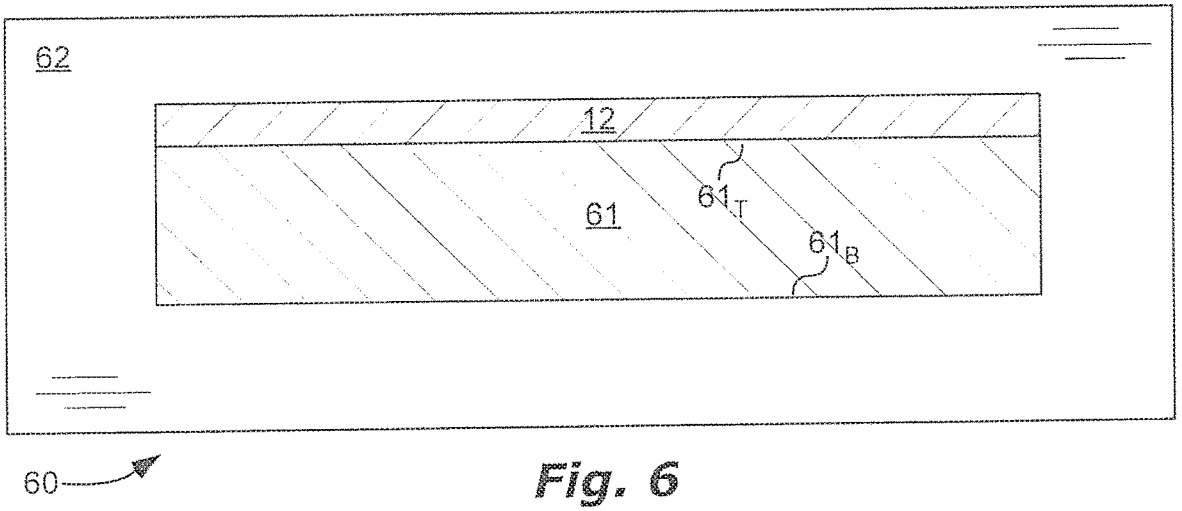

FIG. 6 is a step 60 in a method of manufacturing an x-ray window, comprising placing a wafer 61 in an oven 62, introducing a gas into the oven 62, the gas including boron, and forming a boron layer 12 on the wafer 61, in accordance with an embodiment of the present invention.

Figure 7:
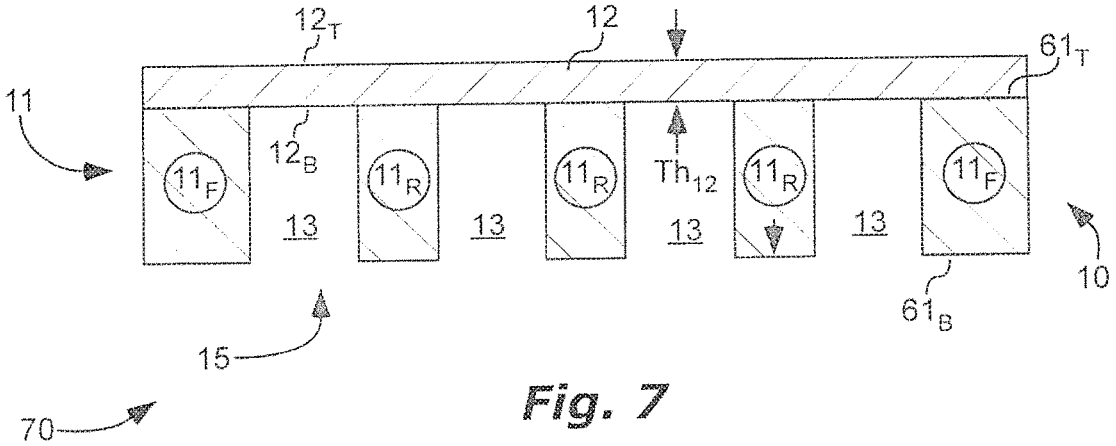

FIG. 7 is a step 70 in a method of manufacturing an x-ray window, following step 60, comprising etching the wafer 61 to form support ribs $\mathbf{11}_R$ extending from a bottom face $\mathbf{61}_B$ of the wafer 61 towards the boron layer 12, in accordance with an embodiment of the present invention.

Figure 8:
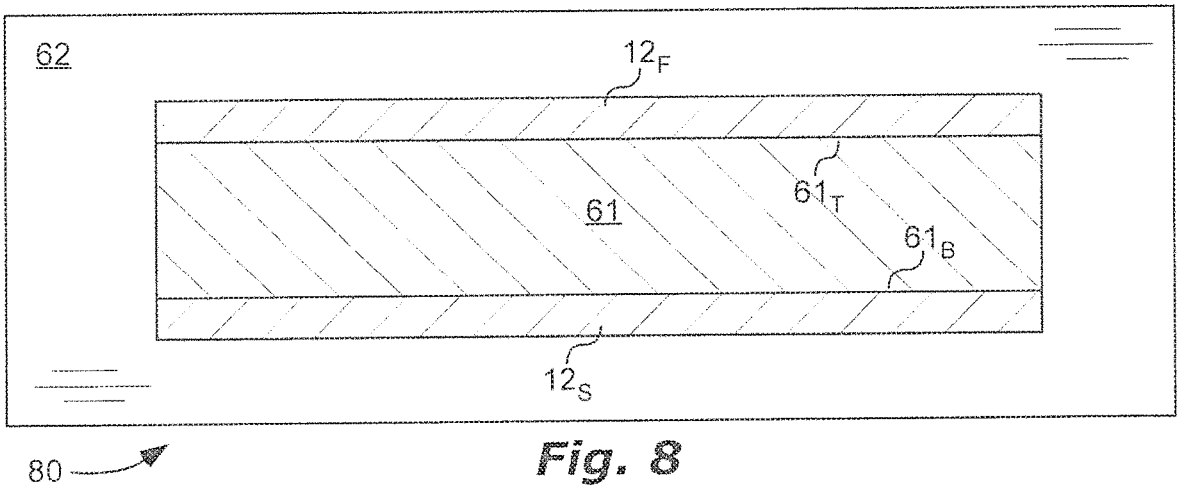

FIG. 8 is a step 80 in a method of manufacturing an x-ray window, comprising placing a wafer 61 in an oven 62, introducing a gas into the oven 62, the gas including boron, and forming a first boron layer $\mathbf{12}_F$ on a top face $\mathbf{61}_T$ of the wafer 61 and a second boron layer $\mathbf{12}_S$ on a bottom face $\mathbf{61}_B$ of the wafer 61, in accordance with an embodiment of the present invention.

Figure 9:
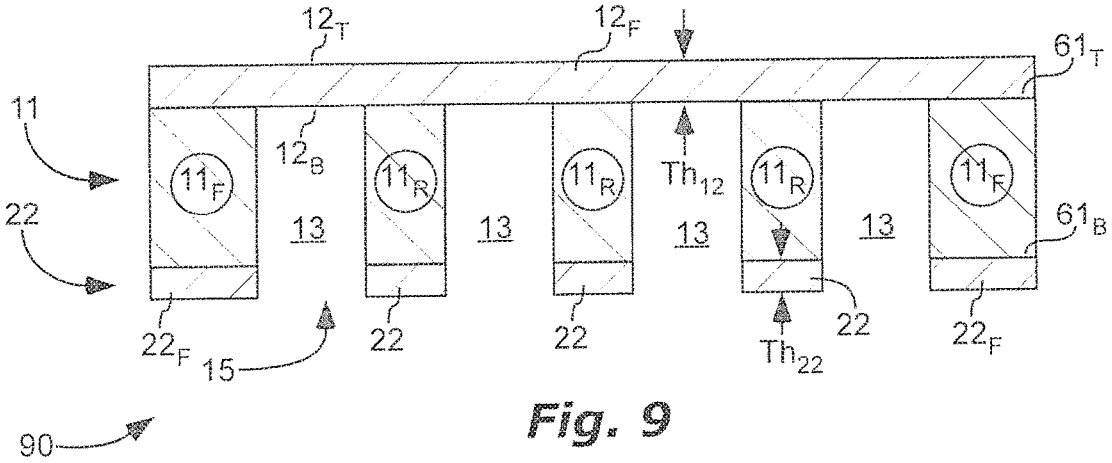

FIG. 9 is a step 90 in a method of manufacturing an x-ray window, following step 80, comprising etching the second boron layer $\mathbf{12}_S$ to form boron ribs 22 and etching the wafer 61 to form support ribs $\mathbf{11}_R$ extending from a bottom face $\mathbf{61}_B$ of the wafer 61 towards or to the first boron layer $\mathbf{12}_F$, in accordance with an embodiment of the present invention.

Figure 10:
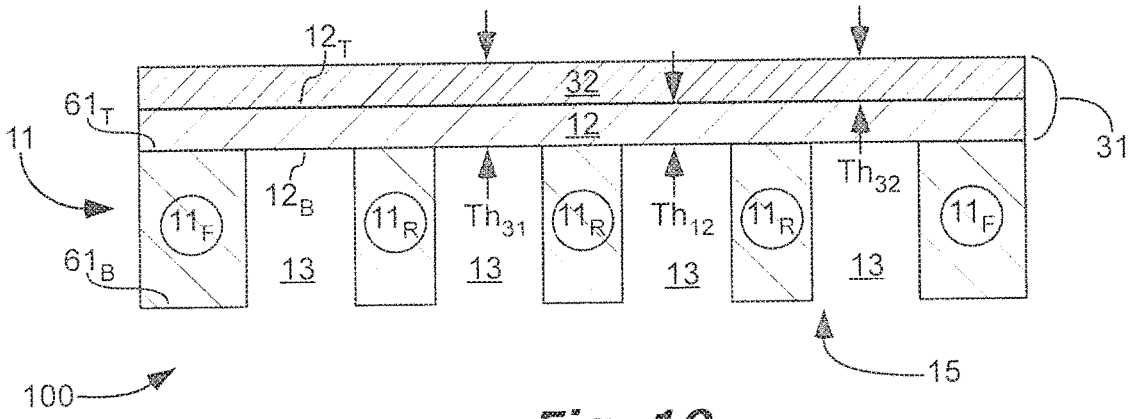

FIG. 10 is a step 100 in a method of manufacturing an x-ray window, following step 70 or step 90, comprising applying an aluminum layer 32 at a top side $\mathbf{12}_T$ of the boron layer 12, in accordance with an embodiment of the present invention.

Figure 11:
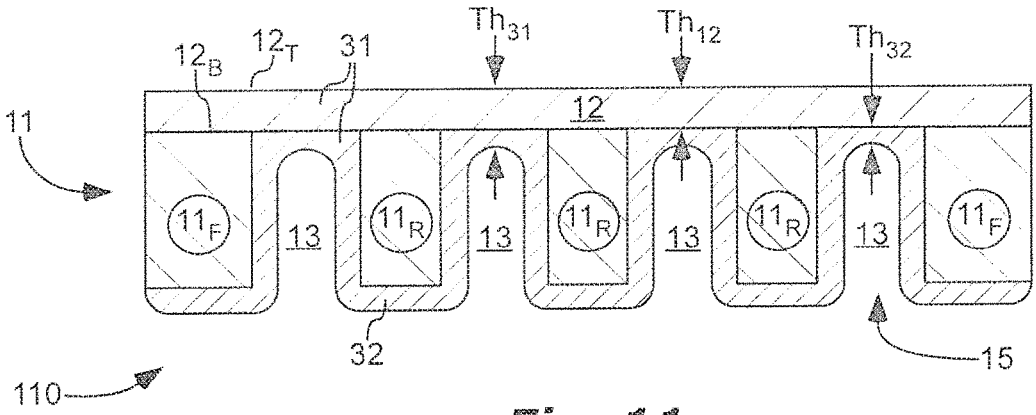

FIG. 11 is a step 110 in a method of manufacturing an x-ray window, following step 70 or step 90, comprising applying an aluminum layer 32 at a bottom side $\mathbf{12}_B$ of the boron layer 12, the aluminum layer 32 conforming to a surface formed by the support ribs $\mathbf{11}_R$ and the boron layer 12, in accordance with an embodiment of the present invention.

Figure 12:
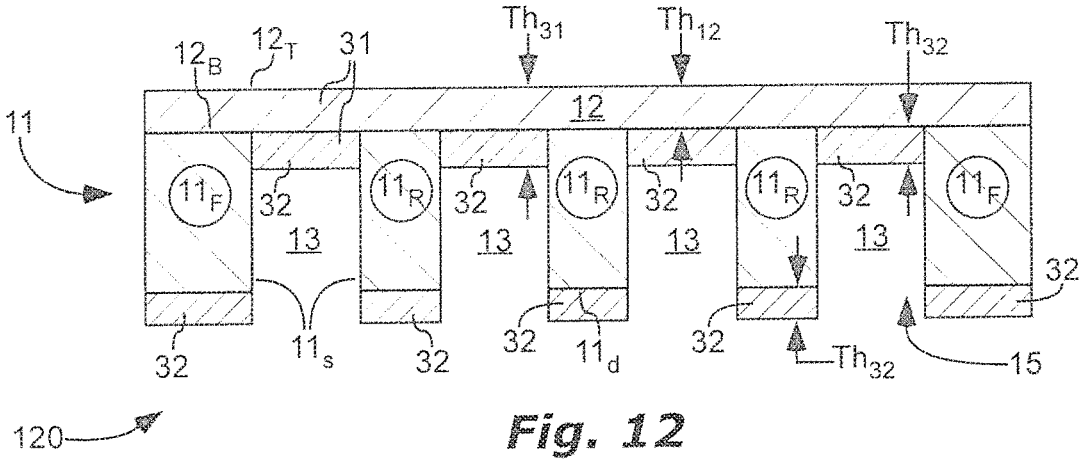

FIG. 12 is a step 120 in a method of manufacturing an x-ray window, following step 70 or step 90, comprising applying an aluminum layer 32 at a bottom side $\mathbf{12}_B$ of the boron layer 12, the aluminum layer 32 adjoining or adjacent to the boron layer 12, to a distal end $\mathbf{11}_d$ of the support ribs $\mathbf{11}_R$, or both, but at least a portion of sidewalls of the support ribs $\mathbf{11}_R$ are free of the aluminum layer 32, in accordance with an embodiment of the present invention.

Figure 13:
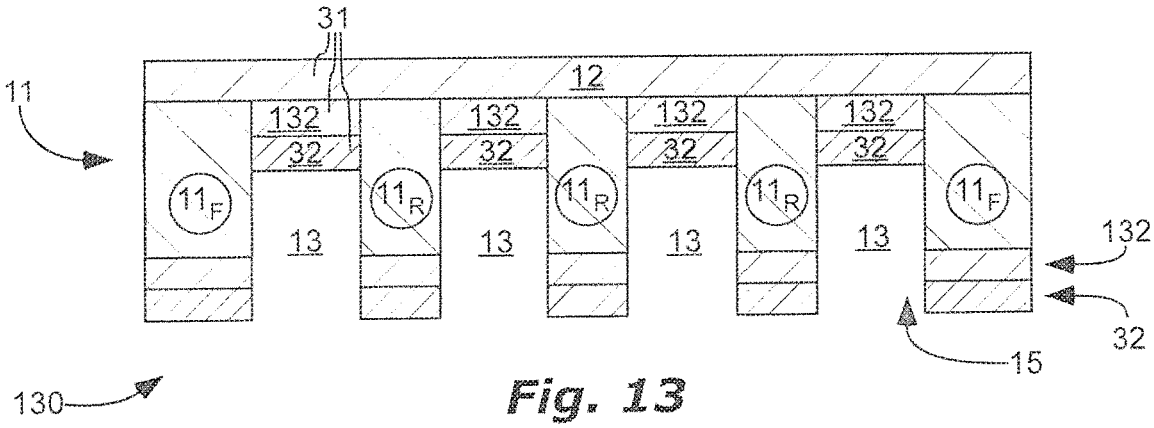

FIG. 13 is a step 130 in a method of manufacturing an x-ray window, before step 100, 110, or 120, comprising applying an adhesion layer 132 on the boron layer 12 before applying the aluminum layer 32, in accordance with an embodiment of the present invention.

Figure 14:
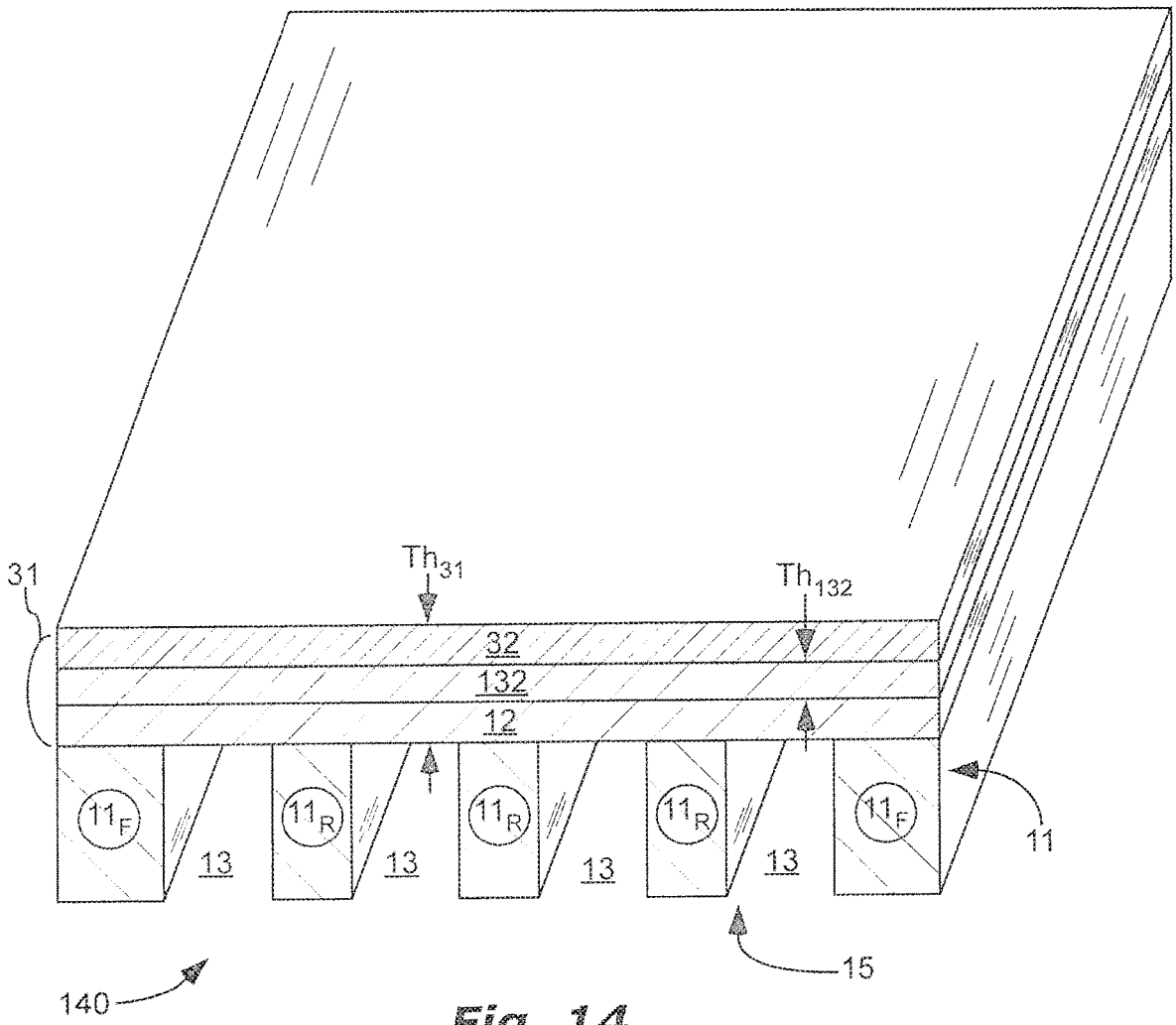

FIG. 14 is a schematic perspective-view of an x-ray window 140, similar to other x-ray windows described herein, but also including an adhesion layer 132 sandwiched between the boron layer 12 and the aluminum layer 32, in accordance with an embodiment of the present invention.

DEFINITIONS

As used herein, the terms "on", "located at", and "adjacent" mean located directly on or located over with some other solid material between. The terms "located directly on", "adjoin", "adjoins", and "adjoining" mean direct and immediate contact.

As used herein, the term "mm" means millimeter(s), "μm" means micrometer(s), and "nm" means nanometer(s).

As used herein, the terms "top face," "top side," "bottom face," and "bottom side" refer to top and bottom sides or faces in the figures, but the device may be oriented in other directions in actual practice. The terms "top" and "bottom" are used for convenience of referring to these sides or faces.

DETAILED DESCRIPTION

As illustrated in FIGS. 1 and 3-4*c*, x-ray windows 10, 30, 40*a*, 40*b*, and 40*c* are shown comprising a support structure 11 including a support frame $\mathbf{11}_F$ encircling an aperture 15 and support ribs $\mathbf{11}_R$ extending across the aperture 15 with gaps 13 between the support ribs $\mathbf{11}_R$. A top view of the support structure 11 is shown in FIG. 2. One example material for the support structure 11 is silicon, such as for example ≥50, ≥75, ≥90, or ≥95 mass percent silicon. Examples of a width $W_{13}$ of the gaps 13 include ≥1 μm, ≥10 μm, or ≥100 μm; and ≤1000 μm or ≤10,000 μm. Examples of a width $W_{11}$ of the support ribs $\mathbf{11}_R$ include ≥1 μm, ≥10 μm, or ≥40 μm; and ≤80 μm, ≤200 μm, or ≤1000 μm.

A boron layer 12 can span the aperture 15 of the support structure 11. The boron layer 12 has a bottom side $\mathbf{12}_B$ which can adjoin and can be hermetically sealed to the support structure 11. Alternatively, another layer of material can be located between the boron layer 12 and the support structure 11. The gaps 13 can extend to the boron layer 12. A material composition of the boron layer can be mostly boron, such as for example ≥60 weight percent, ≥80 weight percent, ≥95 weight percent, ≥96 weight percent, ≥97 weight percent, ≥98 weight percent, or ≥99 weight percent boron.

The boron layer 12 can provide needed characteristics, including strength, with a relatively small thickness. Thus, for example, the boron layer 12 can have a thickness $Th_{12}$ of ≥5 nm, ≥10 nm, ≥30 nm, or ≥45 nm and ≤55 nm, ≤70 nm, ≤90 nm, ≤120 nm, ≤200 nm, ≤500 nm, or ≤1000 nm.

The boron layer 12 can include borophene. The borophene can be embedded in amorphous boron.

The boron layer 12 can include both boron and hydrogen and thus can be a boron hydride layer. Addition of hydrogen can make the boron layer 12 more amorphous, more resilient, lower density, and more transparent to x-rays. For example, the boron hydride layer can include the weight percent boron as specified above and can include ≥0.01 weight percent, ≥0.1 weight percent, ≥0.25 weight percent, ≥0.5 weight percent, ≥1 weight percent, ≥1.5 weight percent, or ≥2 weight percent hydrogen. The boron hydride layer can include ≤1.5 weight percent, ≤2 weight percent, ≤3 weight percent, or ≤4 weight percent hydrogen.

The boron hydride layer 12 can have improved performance if density is controlled within certain parameters. For example, the boron hydride layer can have density of ≥1.7 g/cm$^3$, ≥1.8 g/cm$^3$, ≥1.9 g/cm$^3$, ≥2.0 g/cm$^3$, or ≥2.05 g/cm$^3$, and can have density of ≤2.15 g/cm$^3$, ≤2.2 g/cm$^3$, or ≤2.3 g/cm$^3$. The density of the boron hydride layer can be controlled by temperature, pressure, and chemistry of deposition.

As illustrated in FIG. 1, x-ray window 10 can further comprise boron ribs 22 aligned with the support ribs $\mathbf{11}_R$. The x-ray window 10 can also comprise a boron frame $\mathbf{22}_F$ aligned with the support frame $\mathbf{11}_F$. The support ribs $\mathbf{11}_R$ can be sandwiched between the boron layer 12 and the boron ribs 22. The support frame $\mathbf{11}_F$ can be sandwiched between the boron layer 12 and the boron frame $\mathbf{22}_F$. This design can be particularly helpful for improving overall x-ray window 10 strength plus allowing low energy x-ray transmissivity.

Proper selection of a thickness $Th_{22}$ of the boron ribs 22 can improve x-ray window 10 strength plus improve low energy x-ray transmissivity. Thus, for example, the boron ribs 22 can have a thickness $Th_{22}$ of ≥5 nm, ≥10 nm, ≥30 nm, or ≥45 nm; and a thickness of ≤55 nm, ≤70 nm, ≤90 nm, or ≤120 nm. It can also be helpful for optimal x-ray window strength and x-ray transmissivity if the thickness $Th_{22}$ of the boron ribs 22 is similar to the thickness $Th_{12}$ of the boron layer 12. Thus for example, a percent thickness difference between the boron layer 12 and the boron ribs 22 can be ≤2.5%, ≤5%, ≤10%, ≤20%, ≤35%, or ≤50%, where the percent thickness difference equals a difference in thickness between the boron layer 12 and the boron ribs 22 divided by a thickness $Th_{12}$ of the boron layer 12. In other words, $$\text{percent thickness difference} = \frac{|Th_{12} - Th_{22}|}{Th_{12}}.$$

The boron ribs 22 can have a percent boron and/or a percent hydrogen as described above in regard to the boron layer 12. The boron ribs 22 can have density as described above in regard to the boron layer 12.

For some applications, it can be important for x-ray windows to block visible and infrared light transmission, in order to avoid creating undesirable noise in sensitive instruments. For example, the x-ray windows described herein can have a transmissivity of ≤10% in one aspect, ≤3% in another aspect, or ≤2% in another aspect, for visible light at a wavelength of 550 nanometers. Regarding infrared light, the x-ray windows described herein can have a transmissivity of ≤10%, in one aspect, ≤4% in another aspect, or ≤3% in another aspect, for infrared light at a wavelength of 800 nanometers.

As shown in FIGS. 3-5, the boron layer 12 can be part of a thin film 31. The thin film 31 can face a gas or a vacuum on each of two opposite sides $\mathbf{31}_B$ and $\mathbf{31}_T$. The thin film 31 can include another layer, such as for example an aluminum layer 32 for improved blocking of visible and infrared light. The aluminum layer 32 can have a substantial or a high weight percent of aluminum, such as for example ≥20, ≥40, ≥60, ≥80, ≥90, or ≥95 weight percent aluminum. The boron layer 12 can adjoin the aluminum layer 32, or other layer(s) of material can be sandwiched between the boron layer 12 and the aluminum layer 32. Example maximum distances between the boron layer 12 and the aluminum layer 32 includes ≥4 nm, ≥8 nm, or % ≥15 nm and ≤25 nm, ≤40 nm, or ≤80 nm. This distance between the boron layer 12 and the aluminum layer 32 can be filled with a solid material.

As illustrated in FIGS. 13-14, an adhesion layer 132 can be sandwiched between and can improve the bond between the boron layer 12 and the aluminum layer 32. Example materials for the adhesion layer 132 include titanium, chromium, or both. Example thicknesses $Th_{132}$ of the adhesion layer 132 include ≥4 nm, ≥8 nm, or ≥15 nm and ≤25 nm, ≤40 nm, or ≤80 nm.

As shown in FIG. 3, the aluminum layer 32 can be located at a top side $\mathbf{12}_T$ of the boron layer 12, the top side $\mathbf{12}_T$ being opposite of the bottom side $\mathbf{12}_B$ (the bottom side $\mathbf{12}_B$ adjoining the support structure 11). Alternatively, as shown in FIGS. 4*a-c*, the aluminum layer 32 can be located at the bottom side $\mathbf{12}_B$ of the boron layer 12 between the support ribs $\mathbf{11}_R$. Examples of possible thicknesses $Th_{32}$ of the aluminum layer 32 include ≥5 nm, ≥10 nm, ≥15 nm, or ≥20 nm and ≥30 nm, ≤40 nm, ≤50 nm, ≤200 nm, ≤500 nm, or ≤1000 nm.

As shown on x-ray window 40*a* in FIG. 4*a*, the aluminum layer 32 can conform to a surface formed by the support ribs $\mathbf{11}_R$ and the boron layer 12. Although not shown in FIG. 4*a*, boron ribs 22 can also be sandwiched between the conformal aluminum layer 32 and the support frame $\mathbf{11}_F$ and/or the support ribs $\mathbf{11}_R$. As shown on x-ray window 40*b* in FIG. 4*b*, the aluminum layer 32 can adjoin or can be adjacent to the boron layer 12, can adjoin or can be adjacent to a distal end $\mathbf{11}_d$ of the support frame $\mathbf{11}_F$ and/or the support ribs $\mathbf{11}_R$, but at least a portion of sidewalls $\mathbf{11}_S$ of the support ribs 11 can be free of the aluminum layer 32. The portion of the sidewalls $\mathbf{11}_S$ of the support ribs $\mathbf{11}_R$ free of the aluminum layer 32 can be ≥25%, ≥50%, ≥75%, or ≥90%. X-ray window 40*c* in FIG. 4*c* is similar to x-ray window 40*b*, but with added boron ribs 22 sandwiched between the aluminum layer 32 and the support frame $\mathbf{11}_F$ and/or the support ribs $\mathbf{11}_R$.

The thin film 31 can be relatively thin to avoid decreasing x-ray transmissivity. Thus for example, the thin film 31 can have a thickness $Th_{31}$ of ≤80 nm, ≤90 nm, ≤100 nm, ≤150 nm, ≤200 nm, ≤250 nm, ≤500 nm, or ≤1000 nm. This thickness $Th_{31}$ does not include a thickness of the support ribs $\mathbf{11}_R$ or the support frame $\mathbf{11}_F$. This thickness $Th_{31}$ can be a maximum thickness across a width W of the thin film 31. Examples of the width W of the thin film 31 include ≥1 mm, ≥3 mm, ≥5 mm, or ≥7.5 mm; and ≤50 mm or ≥100 mm.

As shown in FIG. 5, x-ray window 50 can comprise a thin film 31 as described above, but without the support structure 11. X-ray window 50 can be useful for higher transmissivity applications, particularly those in which the x-ray window 50 does not need to span large distances.

It can be important for x-ray windows 10, 30, 40, and 50 to be strong (e.g. capable of withstanding a differential pressure of ≥ one atmosphere without rupture) and still be transmissive to x-rays, especially low-energy x-rays. This is accomplished by careful selection of materials, thicknesses, support structure, and method of manufacturing as described herein. For example, the x-ray window can have ≥20%, ≥30%, ≥40%, ≥45%, ≥50%, or ≥53% transmission of x-rays in an energy range of 50 eV to 70 eV (meaning ≥ this transmission percent in at least one location in this energy range). As another example, the x-ray window can have ≥10%, ≥20%, ≥30%, or ≥40% transmission of x-rays across the energy range of 50 eV to 70 eV.

The x-ray windows 10, 30, 40, and 50 can be relatively strong and can have a relatively small deflection distance. Thus for example, the x-ray window 10, 30, 40, or 50 can have a deflection distance of ≤400 μm, ≤300 μm, ≤200 μm, or ≤100 μm, with one atmosphere differential pressure across the x-ray window 10, 30, 40, or 50. The x-ray windows 10, 30, 40, or 50 described herein can include some or all of the properties (e.g. low deflection, high x-ray transmissivity, low visible and infrared light transmissivity) of the x-ray windows described in U.S. Pat. No. 9,502,206, which is incorporated herein by reference in its entirety.

These x-ray windows 10, 30, 40, and 50 can be relatively easy to manufacture with few and simple manufacturing steps as will be described below. These x-ray windows 10, 30, 40, and 50 can be made of materials with low atomic numbers. Thus for example, ≥30, ≥40, ≥50, or ≥60 atomic percent of materials in the thin film 31 can have an atomic number of ≤5.

Method

A method of manufacturing an x-ray window can comprise some or all of the following steps, which can be performed in the following order. There may be additional steps not described below. These additional steps may be before, between, or after those described.

The method can comprise step 60 shown in FIG. 6, placing a wafer 61 in an oven 62; introducing a gas into the oven 62, the gas including boron, and forming a boron layer 12 on the wafer 61. The boron layer 12 can be a boron hydride layer. The boron layer 12 can have properties as described above. Deposition temperature and pressure plus gas composition can be adjusted to control percent hydrogen and percent boron. In one embodiment, the gas can include diborane.

In one embodiment, the wafer 61 can comprise silicon, and can include ≥50, ≥70, ≥90, or ≥95 mass percent silicon. Examples of temperatures in the oven 62 during formation of the boron layer 12 include ≥50° C., ≥100° C., ≥200° C., ≥300° C., or ≥340° C., and ≤340° C., ≤380° C., ≤450° C., ≤525° C., or ≤600° C. Formation of the boron layer 12 can be plasma enhanced, in which case the temperature of the oven 62 can be relatively lower. A pressure in the oven can be relatively low, such as for example 60 pascal. Higher pressure deposition might require a higher process temperature.

Following step 60, the method can further comprise step 70 shown in FIG. 7, etching the wafer 61 to form support ribs $\mathbf{11}_R$ extending from a bottom face $\mathbf{61}_B$ of the wafer 61 towards the boron layer 12. This step 70 can include patterning a resist then etching the wafer 61 to form the support ribs $\mathbf{11}_R$. Example chemicals for etching the wafer 61 include potassium hydroxide, tetramethylammonium hydroxide, cesium hydroxide, ammonium hydroxide, or combinations thereof. The resist can then be stripped, such as for example with sulfuric acid and hydrogen peroxide (e.g. Nanostrip). Etching can also result in forming a support frame $\mathbf{11}_F$ encircling an aperture 15. The support ribs $\mathbf{11}_R$ can span the aperture and can be carried by the support frame $\mathbf{11}_F$.

Instead of step 60, the method can comprise step 80 shown in FIG. 8, placing a wafer 61 into an oven 62; introducing a gas into the oven 62, the gas including boron, and forming a first boron layer $\mathbf{12}_F$ on a top face $\mathbf{61}_T$ of the wafer 61 and a second boron layer $\mathbf{12}_S$ on a bottom face $\mathbf{61}_B$ of the wafer 61, the bottom face $\mathbf{61}_B$ being a face opposite of the top face $\mathbf{61}_T$. The boron layer 12 can be a boron hydride layer. The boron layer 12 or the boron hydride layer can have properties as described above. The gas, the wafer 61, the temperature of the oven 62, and the plasma can be the same as in step 60.

Following step 80, the method can further comprise step 90 shown in FIG. 9, etching the second boron layer $\mathbf{12}_S$ to form boron ribs 22. This step 90 can include using a solution of potassium ferricyanide, a fluorine plasma (e.g. NF3, SF6, CF4), or both, to etch the second boron layer $\mathbf{12}_S$ to form the boron ribs 22.

This step 90 can further comprise etching the wafer 61 to form support ribs $\mathbf{11}_R$ extending from a bottom face $\mathbf{61}_B$ of the wafer 61 towards the boron layer 12. Example chemicals for etching the wafer 61 are described above in reference to step 70. The support ribs $\mathbf{11}_R$ can be aligned with the boron ribs 22 and can be sandwiched between the boron ribs 22 and the boron layer 12.

This etching can also result in forming a support frame $\mathbf{11}_F$ and/or a boron frame $\mathbf{22}_F$ encircling an aperture 15, The support ribs $\mathbf{11}_R$ can span the aperture and can be carried by the support frame $\mathbf{11}_F$. The boron ribs 22 can span the aperture and can be carried by the boron frame $\mathbf{22}_F$. The support ribs $\mathbf{11}_R$ can be aligned with the boron ribs 22 and can be sandwiched between the boron ribs 22 and the boron layer 12. The support frame $\mathbf{11}_F$ can be aligned with the boron frame $\mathbf{22}_F$ and can be sandwiched between the boron frame $\mathbf{22}_F$ and the boron layer 12.

As shown in FIG. 10, the support ribs $\mathbf{11}_R$ can be located at a bottom side $\mathbf{12}_B$ of the boron layer 12. Following step 70 or step 90, the method can further comprise step 100, applying an aluminum layer 32 at a top side $\mathbf{12}_T$ of the boron layer 12, the top side $\mathbf{12}_T$ being opposite of the bottom side $\mathbf{12}_B$. As shown in FIG. 14, the method can further comprise applying an adhesion layer 132 on the boron layer 12 before applying the aluminum layer 32.

As shown in FIGS. 11 and 12, the support ribs $\mathbf{11}_R$ can be located at a bottom side $\mathbf{12}_B$ of the boron layer 12. Following step 70 or step 90, the method can further comprise step 110 or step 120, applying an aluminum layer 32 at the bottom side $\mathbf{12}_B$ of the boron layer 12. The aluminum layer 32 can coat or touch at least part of the support ribs $\mathbf{11}_R$ and the boron layer 12. As shown in FIG. 13, the method can further comprise step 130, applying an adhesion layer 132 on the boron layer 12 before applying the aluminum layer 32.

In step 110 shown in FIG. 11, the aluminum layer 32 can conform to a surface formed by the support ribs $\mathbf{11}_R$ and the boron layer 12. In step 120 shown in FIG. 12, the aluminum layer 32 can adjoin or can be adjacent to the boron layer 12, can adjoin or can be adjacent to a distal end $\mathbf{11}_d$ of the support frame $\mathbf{11}_F$ and/or the support ribs $\mathbf{11}_R$, but at least a portion of sidewalls $\mathbf{11}_S$ of the support ribs $\mathbf{11}_R$ can be free of the aluminum layer 32. The portion of the sidewalls $\mathbf{11}_S$ of the support ribs $\mathbf{11}_R$ free of the aluminum layer 32 can be ≥25%, ≥50%, ≥75%, or ≥90%.

The aluminum layer 32 in step 100, step 110, or step 120 can have a weight percent of aluminum as described above. The aluminum layer 32 and the boron layer 12 can define a thin film 31. Examples of methods for applying the aluminum layer 32 in step 100, step 110, or step 120 include atomic layer deposition, evaporation deposition, and sputtering deposition. A thickness $Th_{22}$ of the boron ribs 22, a thickness $Th_{12}$ of the boron layer 12, a thickness $Th_{32}$ of the aluminum layer 32, and a thickness $Th_{31}$ of the thin film 31 can have values as described above. Step 100 can be combined with step 110 or step 120 to provide two aluminum layers 32, with the boron layer 12 sandwiched between the two aluminum layers 32.

What is claimed is:

1. A method of manufacturing an x-ray window, the method comprising:

placing a wafer in an oven;

introducing a gas into the oven, the gas including diborane, and forming a first boron layer on a top face of the wafer and a second boron layer on a bottom face of the wafer, the bottom face being opposite of the top face, the first boron layer and the second boron layer each comprising ≥96 weight percent boron and ≥0.1 weight percent hydrogen;

etching the second boron layer to form boron ribs; and etching the wafer to form a support frame encircling an aperture and support ribs spanning the aperture, carried by the support frame, and extending from a bottom face of the wafer towards the boron layer, the boron ribs aligned with the support ribs.

2. The method of claim 1, wherein the first boron layer and the second boron layer each having density of ≥2.0 g/cm$^3$ and ≤2.15 g/cm$^3$.

3. The method of claim 1, wherein the first boron layer and the second boron layer each comprise ≥97 weight percent boron, ≥1 weight percent hydrogen, and ≤3 weight percent hydrogen.

4. The method of claim 1, wherein the first boron layer has a thickness of ≥30 nm and ≤200 nm, the first boron layer is part of a thin film, the thin film faces a gas or a vacuum on each of two opposite sites, and a maximum thickness across a width of the thin film is ≤250 nm.

5. The method of claim 1, wherein etching the second boron layer to form boron ribs includes using potassium ferricyanide, sodium hydroxide, sodium oxalate, or combinations thereof.

6. A method of manufacturing an x-ray window, the method comprising:

placing a wafer in an oven;

introducing a gas into the oven, the gas including boron, and forming a first boron layer on a top face of the wafer and forming a second boron layer on a bottom face of the wafer, the bottom face being a face opposite of the top face;

etching the second boron layer to form boron ribs; and etching the wafer to form support ribs spanning an aperture and extending from a bottom face of the wafer towards the first boron layer, using the first boron layer as an etch stop, the first boron layer and the boron ribs spanning the aperture, and the support ribs aligned with the boron ribs and are sandwiched between the boron ribs and the first boron layer.

7. The method of claim 6, wherein the first boron layer and the second boron layer each comprise ≥97 weight percent boron, ≥1 weight percent hydrogen, and ≤3 weight percent hydrogen.

8. The method of claim 6, wherein the first boron layer has a thickness of ≥30 nm and ≤200 nm, the first boron layer is part of a thin film, the thin film faces a gas or a vacuum on each of two opposite sites, and a maximum thickness across a width of the thin film is ≤250 nm.

9. A method of manufacturing an x-ray window, the method comprising:

placing a wafer in the oven;

introducing a gas into the oven, the gas including boron, and forming a boron layer on the water; and etching the wafer to form support ribs spanning an aperture and extending from a bottom face of the wafer towards the boron layer, the support ribs are located at a bottom side of the boron layer; and applying an aluminum layer at the bottom side of the boron layer between the support ribs.

10. The method of claim 9, wherein the boron layer is a boron hydride layer with ≥96 weight percent boron and ≥0.1 weight percent hydrogen and density of ≥1.8 g/cm$^3$ and ≤2.2 g/cm$^3$.

11. The method of claim 10, wherein the boron hydride layer comprises ≥97 weight percent boron, ≥1 weight percent hydrogen, and ≤3 weight percent hydrogen.

12. The method of claim 9, wherein forming the boron layer is plasma enhanced and the oven has a temperature of between 100° C. and 340° C. during formation of the boron layer.

13. The method of claim 9, wherein the method further comprises applying an aluminum layer at a top side of the boron layer, the top side being opposite of the bottom side.

14. The method of claim 9, wherein the boron layer has a thickness of ≥30 nm and ≤200 nm, the boron layer is part of a thin film, the thin film faces a gas or a vacuum on each of two opposite sites, and a maximum thickness across a width of the thin film is ≤250 nm.

15. The method of claim 9, wherein etching the wafer to form support ribs includes using potassium hydroxide, tetramethylammonium hydroxide, cesium hydroxide, ammonium hydroxide, or combinations thereof.

16. The method of claim 9, wherein:

the boron layer is a first boron layer on a top face of the wafer spanning the aperture;

forming a boron layer on the wafer further comprises forming a second boron layer on a bottom face of the wafer, the bottom face being a face opposite of the top face;

etching further comprises etching the second boron layer to form boron ribs spanning the aperture; and the support ribs are aligned with the boron ribs and are sandwiched between the boron ribs and the boron layer.

17. The method of claim 16, wherein etching the second boron layer to form boron ribs includes using potassium ferricyanide to etch the second boron layer to form the boron ribs.

18. The method of claim 16, further comprising using sodium hydroxide, sodium oxalate, or both to etch the second boron layer to form the boron ribs.

19. The method of claim 9, wherein the boron layer is a boron hydride layer.

20. The method of claim 19, wherein the boron hydride layer has ≥96 weight percent boron and ≥0.1 weight percent hydrogen.

* * * * *